United States Patent [19]

MacNitt, Jr. et al.

[11] Patent Number: 4,531,396

[45] Date of Patent: Jul. 30, 1985

[54] FORGING DIE PACKAGE

[75] Inventors: Donald G. MacNitt, Jr., Singer Island; Raymond M. Walker, Port St. Lucie; Bryant H. Walker, Stuart, all of Fla.

[73] Assignee: United Technologies Corporation, Hartford, Conn.

[21] Appl. No.: 498,240

[22] Filed: May 26, 1983

[51] Int. Cl.[3] ..... B21D 31/00

[52] U.S. Cl. ..... 72/354; 72/358; 72/401; 72/474; 29/159 R

[58] Field of Search ..... 72/38, 343, 344, 352, 72/353, 354, 359, 478, 401, 402; 29/156.8 R, 156.8 B, 159 R

[56] References Cited

U.S. PATENT DOCUMENTS

| | | | |
|---|---|---|---|
| 1,765,807 | 6/1930 | Thomas | 72/481 |
| 2,125,068 | 7/1938 | Dempsey | 72/358 |
| 2,689,539 | 9/1954 | Lyon | 72/481 |
| 2,950,817 | 8/1960 | Graham | 72/478 |
| 3,315,346 | 4/1967 | Duffield | 72/402 |
| 4,040,161 | 8/1977 | Kelch | 72/344 |
| 4,051,708 | 10/1977 | Beane et al. | 72/354 |
| 4,074,559 | 2/1978 | Beane et al. | 29/156.8 B |
| 4,150,557 | 4/1979 | Walker et al. | 72/354 |
| 4,252,011 | 2/1981 | MacNitt, Jr. et al. | 72/354 |
| 4,265,105 | 5/1981 | MacNitt, Jr. et al. | 72/354 |

*Primary Examiner*—Daniel C. Crane
*Assistant Examiner*—David B. Jones
*Attorney, Agent, or Firm*—Stephen E. Revis

[57] ABSTRACT

A die package for forming a central disc structure having a plurality of integrally formed appendages extending therefrom includes a cylindrical array of appendage forming, abutting die segments which are prevented from tilting or moving in a circumferential direction by means of pins extending into slots formed along the parting lines between abutting die segments in the upper surfaces of the segments. In one embodiment, the pins extend upwardly from between opposed, parallel, radially and axially extending walls of each slot and fit tightly between said walls. The upper ends of the pins are secured to a rigid annular ring overlying the slots. The slots extend radially inwardly of the pins to allow the die segments to be moved radially outwardly after forging to release the forging from the die package.

6 Claims, 4 Drawing Figures

FORGING DIE PACKAGE

CROSS REFERENCE TO RELATED PATENT APPLICATIONS

This application is of related subject matter to commonly owned U.S. patent application Ser. No. 498,233 filed on even date herewith titled "Forging Method and Die Package Therefor" by Bryant H. Walker.

TECHNICAL FIELD

This invention relates to forging apparatus and particularly to die assemblies in which a billet of stock material is deformed at elevated temperatures to a desired shape.

The concepts were developed in the gas turbine engine field for the production of integrally bladed rotors, but have wide applicability in any industry in which similarly configured parts of accurate dimension are desired.

BACKGROUND ART

U.S. Pat. No. 3,519,503 to Moore et al entitled "Fabrication Method for the High Temperature Alloys", of common assignee herewith, describes a forging process developed by Pratt & Whitney Aircraft, Division of United Technologies Corporation, Hartford, Connecticut and known internationally as the GATORIZING® forging process. By the disclosed process, high strength, difficult to forge alloys such as those used in the gas turbine engine industry, are deformable from a billet of stock material to a nearly finished shape of relatively complex geometry. Although, only disk-shaped components were initially forged, the attractiveness of forming integrally bladed rotor disks spurred subsequent developments.

An initial die package and process for forming such integrally bladed rotors is disclosed and illustrated in U.S. Pat. No. 4,051,708 to Beane et al entitled "Forging Method" and in the divisional case thereof U.S. Pat. No. 4,074,559 to Beane et al also entitled "Forging Method". Both patents are of common assignee herewith. In accordance with these concepts, integral appendages are forged between a plurality of adjacent dies positioned about the circumference of the disk forming dies. Yet further advances include the techniques for separating the appendage forming dies from the finished forging. Two such techniques are illustrated in U.S. Pat. No. 4,040,161 to Kelch entitled "Apparatus and Method for Removing a Plurality of Blade Dies" and 4,150,557 to Walker et al entitled "Forging Apparatus Having Means for Radially Moving Blade Die Segments".

Commonly owned U.S. Pat. No. 4,312,211 and 4,265,105 both by MacNitt, Jr. et al describe a forging method and apparatus wherein two concentric dies are moved sequentially against a billet to form the forged component in two steps. The first die is moved and compresses a billet to an intermediate configuration. The first die is then held stationary against the partially compressed billet while the second die is moved to compress the billet to a final configuration.

In several of the foregoing patents (e.g. 4,252,011) the forging apparatus described is an automated one, wherein a die package is first assembled and then automatically moved into position within a bull ring and is heated to forging temperatures, whereupon the actual forging step takes place. The die package, containing the finished forging, is then automatically moved to another station and the forged part is removed.

It is required, for some forged parts, that tolerances on the as-forged part be extremely close. This requires that the appendage forming die segments be precisely located at the time of and during forging. Two separate problems have been discovered in connection with this requirement. The first problem is initially assembling the die package with the die segments precisely located relative to each other, and being able to move that die package into position between the forging dies without any of its components moving out of position. The second problem involves maintaining the die segments in position throughout the actual forging step. If the die segments are not correctly located at the time of assembly, or if they move somewhat as the die package is moved into the forging press, then it will make no difference that the die package is held stationary throughout the forging process, since the die segments will not be in the proper position to begin with. On the other hand, if the die package is precisely and accurately positioned at the beginning of the forging cycle, the finished component may not meet required tolerances if, during the forging cycle, the die segments move out of position. The problem is aggrevated when parts of complex shape, such as disks having highly twisted airfoils integral therewith, are being forged.

Commonly owned U.S. Pat. No. 4,252,011, MacNitt Jr. et al describes apparatus for preventing relative tilting (i.e. for stabilizing) the die segments of a die package throughout the forging operation. More specifically, annular ring forming means are disposed in interlocking relationship with the inner circumferential surfaces of the appendage forming die segments. The MacNitt Jr. et al invention has not proved to be totally satisfactory in all cases, particularly when forging centrifugal rotors having blades with unusually high degrees of twist.

DISCLOSURE OF INVENTION

One object of the present invention is a die package for forging a central disc structure having a plurality of integrally formed appendages extending therefrom, wherein the die package can be assembled with its components accurately located and can be moved into position within a forging press without movement of the die package components during the transfer process.

Another object of the present invention is a die package for forging a central disc structure having a plurality of integrally formed appendages extending therefrom wherein the elements of the disc package remain precisely located during the actual forging of the component.

According to the present invention, a die package for forming a central disc structure having a plurality of integrally formed appendages extending therefrom includes a cylindrical array of appendage forming die segments which are prevented from tilting or moving in a circumferential direction by means of pins extending into slots formed along the parting lines between abutting die segments.

According to one aspect of the invention, radially and axially extending slots having opposed, parallel, spaced apart wall surfaces are formed along the parting lines between abutting circumferentially disposed die segments of the die package, the slots extending to the upper surfaces of the die segments. A rigid annular ring is disposed on the upper surfaces and overlies the slots and includes pins extending downwardly therefrom, one each into each slot. The slots extend radially inwardly of the pins and are located on the parting lines of the die segments to allow the die segments to be knocked radially outwardly relative to the pins to enable removal of the forging.

In a preferred embodiment the die segments rest on an upwardly facing surface of a lower forging die, which is part of the die package. The central portion of the forging die has an upper surface which forms the shape of one side of the central disc structure. The inner arcuate surfaces of each die segment contacts an outer cylindrical surface of this central portion. Axially oriented rods extend upwardly through holes in the lower forging die and into mating, opposed recesses in the inner arcuate surfaces of the die segments and the outer cylindrical surface of the forging die. The rods position the die segments relative to the lower forging die and also help prevent tilting of the segments within the die package.

The foregoing and other objects, features and advantages of the present invention will become more apparent in the light of the following detailed description of preferred embodiments thereof as shown in the accompanying drawing.

BEST MODE FOR CARRYING OUT THE INVENTION

The present invention is known to have high utility in the forging field, and particularly in the forging of components having complex geometries by the techniques described in U.S. Pat. No. 3,519,503 to Moore, et al entitled "Fabrication Method for the High Temperature Alloys". The Moore et al process is well suited to automated manufacture such as that illustrated in the FIG. 1, a simplified representation of an automated forging apparatus. A die package 10 is first assembled either automatically or by hand. In this embodiment the die package is designed to form a centrifugal rotor comprising a central disk structure having a plurality of circumferentially spaced curved blades extending radially outwardly therefrom. As will be further described hereinafter, the die package 10 includes a lower forging die having secured thereto a plurality of circumferentially disposed blade forming dies defining a cavity into which a billet 11 is disposed. An upper forging die 12 is placed on top of the billet 11. The upper and lower forging dies have bottom and top surfaces, respectively, shaped to form the upper and lower surfaces of the disk structure which is being forged.

Figure 1:
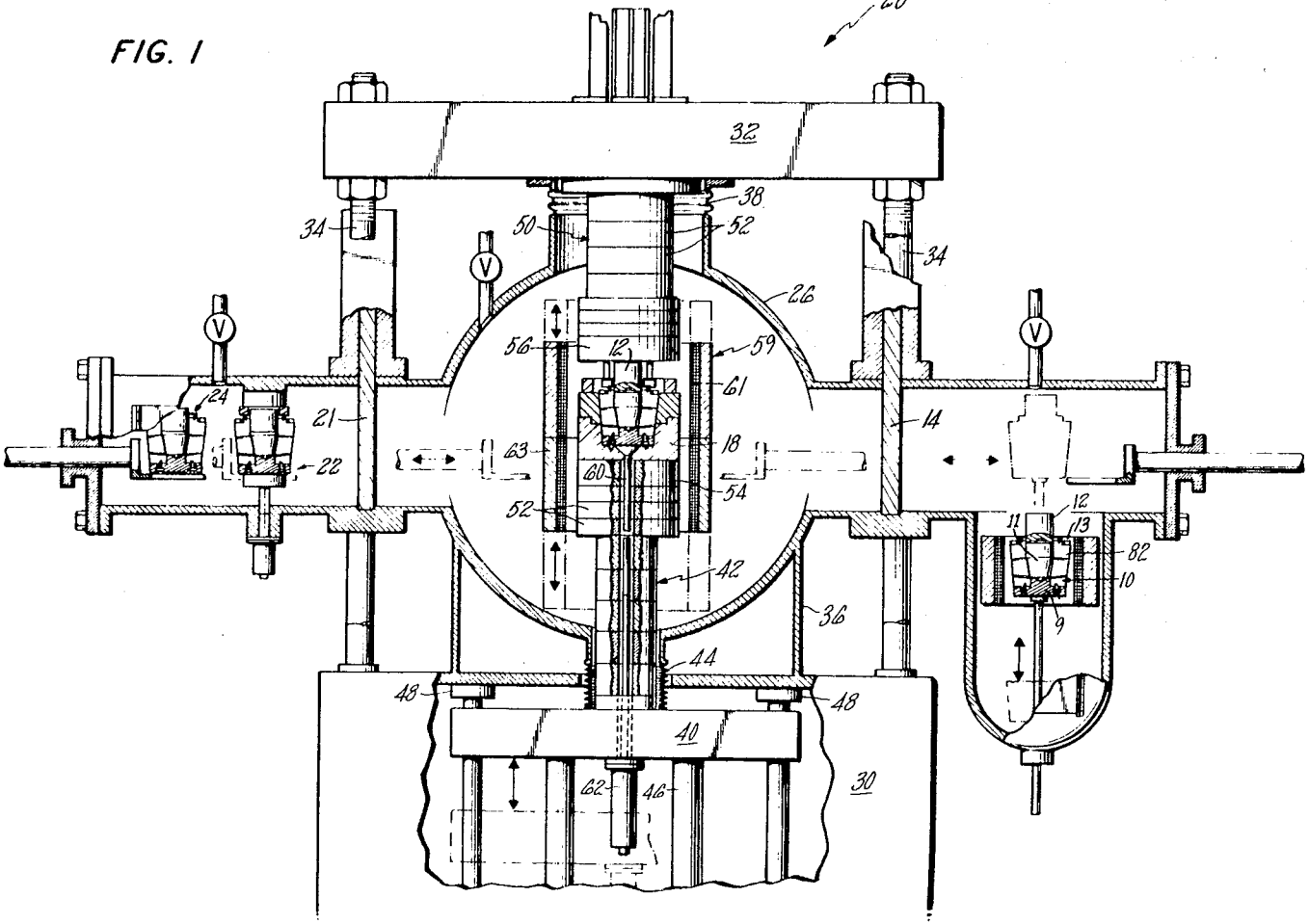
FIG. 1 is a schematic representation of forging apparatus in which the concepts of the present invention are employable.

The assembled die package 10 is placed in a preheat furnace 13 wherein the temperature of the die package, including the billet and forging die, is raised to an intermediate temperature well below the temperature at which the forging process is to be executed. The heated die package is then shuttled through a door 14 to a forging station, wherein it is placed in a bull ring 18 between the die plates of a forging press generally represented by the numeral 20. In FIG. 1, the billet 11 is yet to be compressed. Simultaneously, a second assembled die package, including a billet and upper forging die is loaded into the preheat furnace 13. The originally preheated die package is raised to forging temperatures and the billet is then deformed within the die package to a desired geometry. Suitable forging temperatures and pressures are disclosed in aforementioned U.S. Pat. No. 3,519,503. The deformed billet and die package are next raised out of the bull ring 18 and shuttled through the door 21 to a die expansion station 22, and thence to a cool down station 24. The second die package is shuttled into the bull ring 18 and the process is continued until the desired number of parts are formed.

More specifically, the forging process is performed within a containment vessel 26 under a hydraulic press 20. The press has a bed 30 and a head 32 which are spaced apart by a plurality of tie rods 34, The containment vessel is supported by a structure 36 extending upwardly from the press bed. The upper end of the containment vessel is joined to the press head at a bellows 38. A ram plate 40 within the press bed 30 supports a lower die column 42 within the containment vessel 26. The ram plate 40 is moveable with respect to the containment vessel 26 and is joined thereto by a bellows 44. A plurality of forging rams 46 position the plate 40 and move the plate 40 upwardly with great force during the forging process. The forging rams are moveable by a hydraulic actuator not shown. A plurality of ram stops 48 extend upwardly from the ram plate to limit upward travel of the plate during the forging process. An upper die column 50 extends downwardly from the press head into the containment vessel. Both the upper die column 50 and the lower die column 42 are made up of a plurality of flat plates 52. The top plate 54 of the lower die column and the bottom plate 56 of the upper die column are manufactured of a hiqh thermal conductivity material, such as molybdenum or an alloy thereof. The other plates in the die column are made from low thermal conductivity material. A bull ring 18, also of high thermal conductivity material, such as molybdenum, rests atop the plate 54 of the lower die column. Although in this embodiment the upper forging die 12 is part of the die package, it could instead be permanently affixed to the upper die column 50.

In FIG. 1, the die package 10 is positioned within the bull ring 18 and is shown just prior to compression of the billet 11. A heating furnace 59 provided within the forging chamber is split into an upper heating element 61 and a lower heating element 63. The two heating elements are vertically separable to allow the die package to be inserted into and removed from the bull ring 18 during the automated process. A breakout ram 60 extends upwardly through the lower die column and the bull ring 18 from an actuator 62 for lifting the die package 10 from the bull ring for subsequent removal to the expansion station 22.

Figure 2:
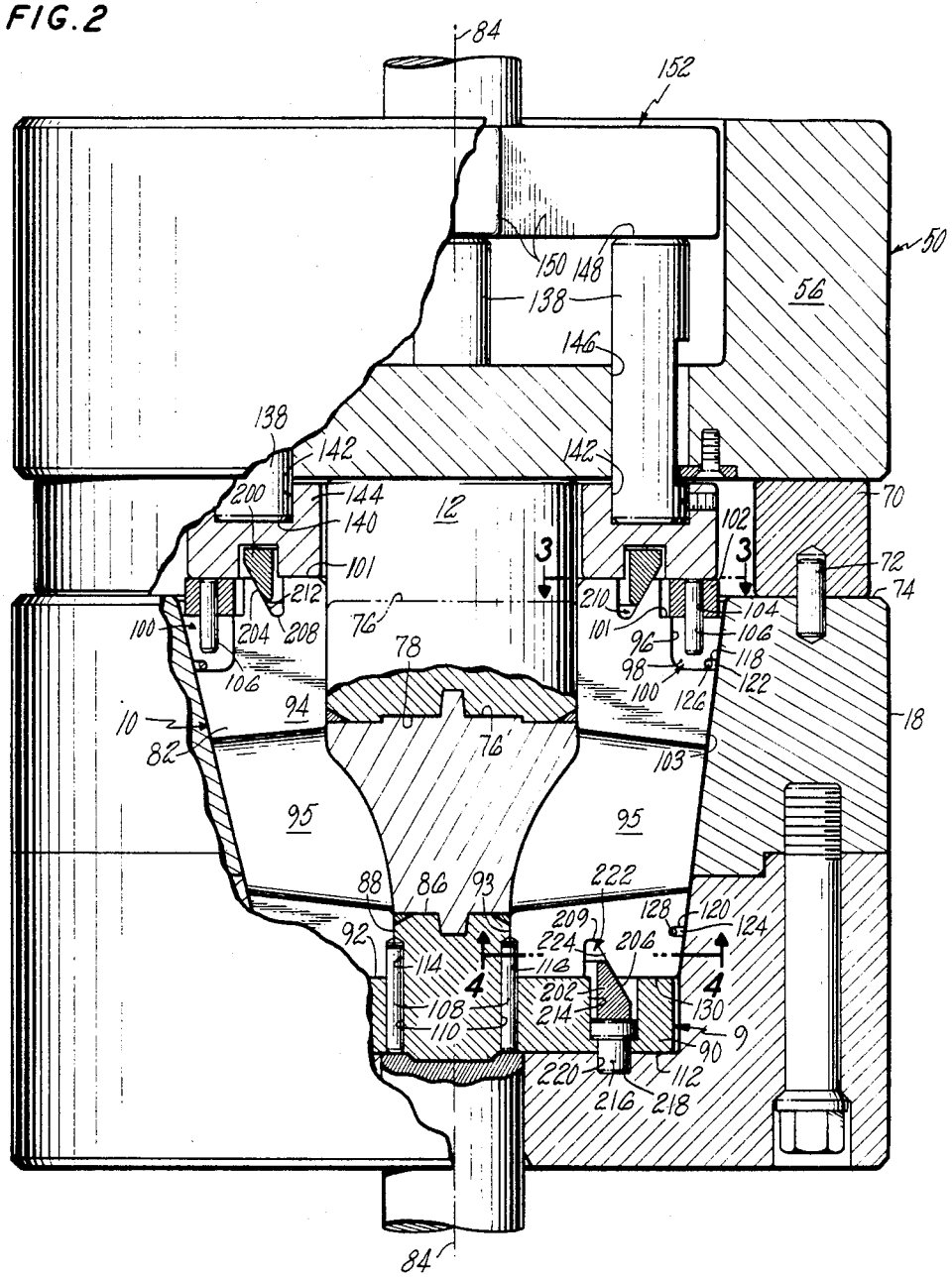
FIG. 2 is a view, partly in section, of a die package within a forging press, wherein the billet has been fully compressed.

Further details of the die package 10 and the forging press 20 are shown in FIG. 2. In FIG. 2 the lower die column 42 has been moved upwardly to its uppermost position, which position is determined by an annular stop ring 70 secured by pins 72 to the uppermost surface 74 of the bull ring 18. The original position of the upper surface of the billet 11 is shown in phantom at 76. After forging, the upper surface of the billet material is designated by the reference numeral 76', and has the shape of the forging surface 78 of the upper forging die 12.

Figure 3:
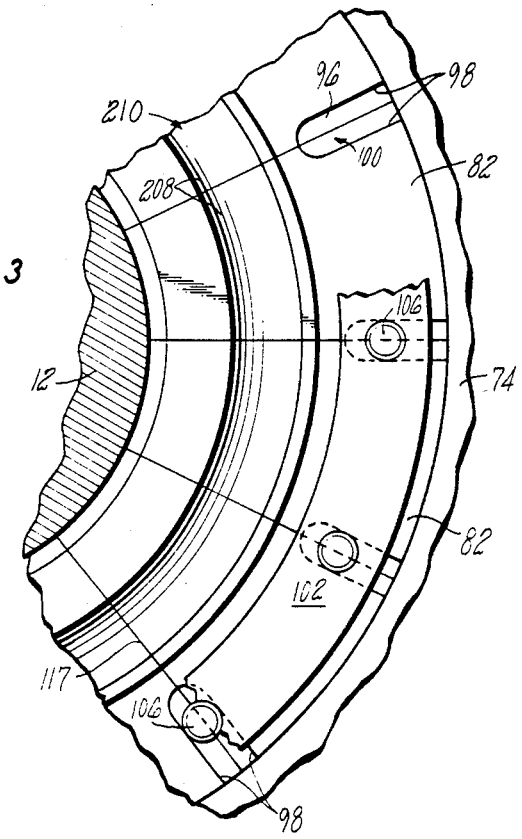
FIG. 3 is a view taken along the line 3—3 of FIG. 2 with knock-out ring 200 removed.
Figure 4:
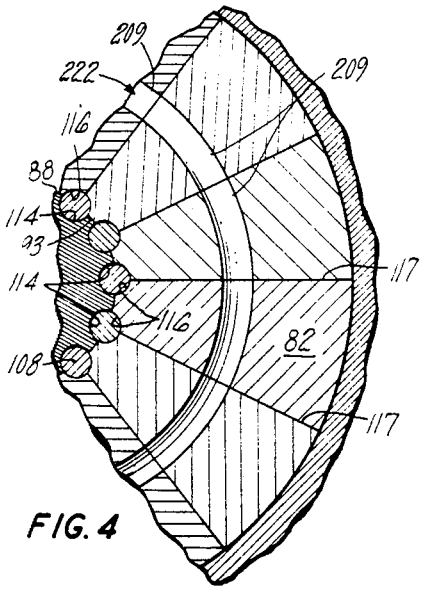
FIG. 4 is a sectional view taken along the line 4—4 of FIG. 2.

Referring to FIGS. 2 through 4, the die package 10 comprises a lower forging die 9 and a plurality of die inserts or die segments 82. The lower forging die 9 is generally cylindrical in shape about a central axis 84 and includes a top surface 86 formed to the inverse geometry of one side of the central disc structure being forged. The surface 86 terminates at a radially outwardly facing generally cylindrical outer surface 88. The lower forging die 9 also includes a die segment support portion 90 having an axially upwardly facing annular surface 92 extending radially outwardly from the cylindrical surface 88. Each segment 82 has an inner arcuate surface 93 which mates with the outer surface 88 of the lower forging die 9. Each of the die segments 82 also has a pair of circumferential side walls 94 which are contoured to form, in conjunction with the side walls 94 of circumferentially adjacent segments 82, a plurality of circumferentially spaced cavities 95 having the inverse geometry of the appendages (i.e. blades) to be formed.

As best shown in FIGS. 2 and 3, in accordance with the present invention, each side wall 94 includes a recess 96. Each recess 96 has a flat, axially and radially extending surface 98. The surfaces 98 of the recesses 96 in each pair of abutting side walls 94 are spaced apart, parallel, and opposed to each other thereby defining a slot 100 therebetween. As shown in this embodiment, the slots 100 extend to the upper surfaces 101 and to the outer arcuate surfaces 103 of the die segments. A rigid, annular support member 102 surrounds the axis 84 of the die package and rests on the upper surfaces 101, overlying the slots 100. The ring 102 includes a plurality of axially extending holes 104 therethrough, one hole being aligned with each slot 100. A pin 106 is disposed within each hole 104 of the support member 102. The upper end of each pin 106 fits tightly within the hole 104, and the lower end of the pin extends into and fits tightly between the surfaces 98 of the slot 100. The support member 102, in combination with the pins 106 and slots 100 prevent tilting of the die segments 82 relative to each other.

The die segments 82 are further stabilized against tilting in the circumferential direction and from moving in the circumferential direction relative to the lower forging die 9 by means of a plurality of cylindrical stabilizer rods 108. The rods 108 fit tightly within first cylindrical holes 110 in the lower forging die 9, which holes extend axially upwardly from the bottom surface 112 of the forging die. The outer surface 88 of the die 9 and the mating inner arcuate surfaces 93 of the die segments 82 include cooperating recesses 114, 116, respectively, which define second cylindrical holes aligned with and forming extensions of each hole 110. The upper ends of the rods 108 fit tightly within such second holes. As shown in FIG. 4, the recesses 116 are on the parting lines 117 between abutting die segments 82, such that each recess 116 forms approximately 90° of each second cylindrical hole, and the recess 114 forms the remainder of the cylinder. It is not required that the rods 108 be located on the parting lines, but any single hole forming recess 116 in a segment 82 cannot comprise greater than about 180° of a full cylindrical hole or the die segments 82 will not be able to be moved radially outwardly to release the forging.

The outer arcuate surface 103 of each die segment 82 also includes an upper and lower groove 118, 120 respectively, extending thereacross to form, in combination with the grooves of adjacent segments, an upper channel 122 and a lower channel 124, each of which extends fully around the cylindrical array of segments 82. A wire 126, 128 is disposed within each channel 122, 124 respectively, and surrounds the die segment array. The wires hold the segments together and prevent radial movement thereof during transport of the die package to and from the bull ring 18 during the automated forging operation described previously with respect to FIG. 1. This technique for radially restraining the die segments 82 is not considered a part of the present invention and is described in commonly owned U.S. Pat. No. 4,252,011, referred to above.

We have also discovered that, as the forging die 12 is pressed into the billet 11 and forces the billet material into the appendage forming cavities 95, the forces exerted on the die segments 82 can actually cause axial elongation of the die segments 82, particularly if the appendages being formed have an exceptionally large amount of twist. Essentially, as the material is forced into the cavities 95, the forces created thereby tend to "unbend" or straighten the die segments such that the axial distance between the bottom surfaces 130 and the top surfaces 101 increase during forging. In the present invention this is prevented by the use of a plurality of axially extending, cylindrical hold-down pads 138 circumferentially disposed about the axis 84. The lower end 140 of each pad 138 is disposed within a recess 142 in an annular hold-down ring 144 which rests on the upper surfaces 101 of the die segment 82 and, in this embodiment, on top of the support member 102. The pads 138 extend through and fit loosely within holes 146 through the lowermost plate 56 of the upper die column 50. The pads 138 can thereby move axially relative to the die column 50. The upper end 148 of each pad 138 contacts an arm 150 of a spider 152 which may be moved vertically within the die column 50 by an actuator, not shown. During the forging operation the spider 152 applies a vertically downward force against the pads 138, thereby pressing the hold-down ring against the die segments 82. This prevents any axial elongation of the die segments as the billet material is forced into the cavities of the die package.

In the present embodiment the means for knocking out or expanding the array of die segments 82 after forging includes cooperating cam means similar to that shown and described in commonly owned U.S. Pat. No. 4,150,557. However, in the present invention, the entire cam means is a part of the moveable die package 10. In the '557 patent the cam means is incorporated into the die column of the forging press. Referring to FIG. 2, the knock-out means comprises upper and lower wedge shaped annular cam rings 200, 202, respectively. The upper ring 200 has a frusto-conical cam surface 204 which tapers upwardly and radially outwardly; and the lower ring 202 has a frusto-conical cam surface 206 which tapers downwardly and radially outwardly. Each die segment 82 includes an arcuate wedge shaped groove 208 in its upper surface 101, and an arcuate wedge shaped groove 209 in its lower surface 130. The grooves 208 of the segments 82 define a wedge shaped annulus 210 having an upwardly and radially outwardly tapered frusto-conical cam surface 212, which surface mates with a portion of the cam surface 204 of the ring 200 which rests thereon. In this embodiment, the ring 200 is part of the die package 10, but it could instead be permanently located at the expansion station 22 (FIG. 1).

The cam ring 202 is disposed in an annular recess 214 in the surface 92 of the lower forging die 9. The ring 202 rests on a plurality of knockout pins 216 having lower ends 218 which protrude from the bottom surface 112 of the die 9 into holes 220 in the bull ring 18. The grooves 209 define a wedge shaped annulus 222 having a downwardly and radially outwardly tapered frusto-conical cam surface 224 which is axially aligned with and mates with a portion of the cam surface 206 of the cam ring 202.

Means are provided at the expansion station 22 (FIG. 1) to simultaneously force the cam rings 200, 202 axially toward the die segments 82, whereby the segments 82 are all moved slightly radially outwardly (e.g. 0.030 inch) and are thereby prevented from becoming "frozen" to the forging during cool down. The wires 126, 128 have insufficient strength to prevent such outward movement, but they do hold the die package together thereafter until it is subsequently disassembled and the forged component is removed at a different station, not shown in FIG. 1.

Although the invention has been shown and described with respect to a preferred embodiment thereof, it should be understood by those skilled in the art that other various changes and omissions in the form and detail thereof may be made therein without departing from the spirit and the scope of the invention.

We claim:

1. A die package for forging a component comprising a central disc structure having a plurality of integrally formed appendages extending therefrom, said die package having a central axis and comprising:

(1) a first forging die of generally cylindrical geometry having a cylindrical outer surface and a top surface formed to the inverse geometry of one side of the central disc structure;

(2) a cylindrical array of circumferentially adjacent die segments stationary relative to said first forging die, each segment having (a) a pair of substantially oppositely facing side walls in abutting relationship with the side walls of the adjacent segments and being contoured to form therewith a plurality of circumferentially spaced cavities of the inverse geometry of the appendages to be formed, wherein each side wall also includes a recess having a flat, axially and radially extending surface portion, said surface portion being opposed to, parallel to, and spaced apart from said surface portion of an abutting side wall defining a slot therebetween, said slot extending axially to said upper surface;

(b) a radially outwardly facing outer surface, (c) an inner arcuate cylindrical surface contacting said outer surface of said first forging die, (d) a bottom surface, (e) an upper surface, (3) stabilizer means comprising a rigid support member surrounding said axis and disposed on said upper surfaces and overlying said slots, and a plurality of circumferentially spaced apart pins fixidly secured to said support member, one of said pins extending into each of said slots and fitting tightly between said opposed surface portions thereof, each slot extending radially inwardly beyond its respective pin to allow radially outward movement of said die segments relative to said pins after forging; and (4) radial restraint means in engagement with each of said die segments to prevent radially outward movement thereof.

2. The die package according to claim 1 wherein said first forging die includes a segment support portion fixed thereto and extending radially outwardly from said first forging die outer surface, said die segments being disposed on and in contact with said support portion, and wherein said first forging die outer surface and each die segment inner surface includes cooperating cavities defining a plurality of axially extending first cylindrical holes, each hole being partially formed by both said first forging die and at least one die segment, said first forging die having a bottom surface and a plurality of second cylindrical holes extending axially upwardly from said first forging die bottom surface, one each of said second holes aligned with and intersecting each of said first holes, said die package including a plurality of cylindrical stabilizer rods, one corresponding to each of said aligned pairs of first and second holes, each stabilizer rod having a portion of its length fitting tightly within each of said first and second holes to locate said die segments relative to said first forging die and to maintain the orientation and position of said segments during forging.

3. The die package according to claim 2 including knock-out means associated with said die segment bottom surfaces and with said die segment upper surfaces and movable into engagement therewith to move said die segments radially outwardly after forging.

4. The die package according to claim 2 wherein said first cylindrical holes are on the parting lines defined between abutting die segments.

5. The die package according to claim 1 wherein said support member is an annular ring having a plurality of axially extending holes therein, one hole corresponding to each of said slots and aligned therewith, each of said pins having an upper end extending into and fitting tightly within a corresponding one of said holes to secure said pins to said support member.

6. Forging apparatus comprising:

a die package according to claim 1, said die segments defining a central cavity within said die package for disposing a billet to be deformed;

an upper die column having a downwardly facing bottom surface;

a lower die column having an upwardly facing top surface spaced apart from and opposed to said upper die column bottom surface, said die package being disposed between said upper die column bottom surface and said lower die column top surface;

means for moving said upper and lower die columns toward each other for pressing a billet disposed within said central cavity into said appendage forming cavities of said die package; and hold down means operably moveable toward and into contact with said upper surfaces of said die segments for applying a continuous axial compressive load on said die segments as said die columns are moved toward each other to prevent axial elongation of said die segments during forging.

* * * * *